United States Patent [19]

Gunning

[11] 4,189,917

[45] Feb. 26, 1980

[54] AIR HAMMER AND MUFFLER COMBINATION

[75] Inventor: Samuel D. Gunning, Cleveland Heights, Ohio

[73] Assignee: Kent Air Tool Company, Kent, Ohio

[21] Appl. No.: 943,324

[22] Filed: Sep. 18, 1978

[51] Int. Cl.[2] ..... F15B 11/06

[52] U.S. Cl. ..... 60/370; 60/371; 60/469; 173/DIG. 2

[58] Field of Search ..... 60/369, 370, 371, 407, 60/469; 173/DIG. 2

[56] References Cited

U.S. PATENT DOCUMENTS

| | | | |
|---|---|---|---|
| 3,625,295 | 12/1971 | Gunning | 173/DIG. 2 UX |
| 4,018,291 | 4/1977 | Anderson | 173/DIG. 2 X |
| 4,105,080 | 8/1978 | Gunning | 173/66 |

*Primary Examiner*—Edgar W. Geoghegan
*Attorney, Agent, or Firm*—John Harrow Leonard

[57] ABSTRACT

The air hammer is of the type employing a body having a first portion with a central bore and a piston reciprocable in the bore by pressurized air under control of an automatic valve. The body has a second or muffler portion which embraces the first portion and is operative to muffle the noise created by exhaust air from the bore. The muffler portion is provided with pressurized air passage means through which the pressurized air must pass for causing operation of the piston. The passage means are so arranged that removal of the muffler portion from the body disrupts the supply of pressurized air to the piston and thereby renders the hammer inoperative. Headers are provided on the ends of the body and are drawn tightly against the ends of the muffler portion by tie bolts which extend through through-passages, respectively, in the muffler portion. The through-passages are of larger diameter than the associated bolts, and the clearance spaces between the through-passages and their associated bolt provide a portion of said passage means, and act to deliver live air to the piston, to accumulate pressurized air, and to deliver pressurized air for actuating the automatic valve.

19 Claims, 12 Drawing Figures

AIR HAMMER AND MUFFLER COMBINATION

BACKGROUND OF THE INVENTION (1) Field of Invention

Air operated muffled hammers.

(2) Prior Art

This invention relates to air hammers of the reciprocating piston type in which pressurized air, delivered through a manual inlet valve and an automatic control valve to a control bore in the hammer barrel, drives the piston on its power stroke and, upon the piston delivering its blow, drives the piston on its return stroke. These strokes alternate repeatedly in succession so long as the pressurized air admitted to the hammer bore by setting of the manual inlet valve remains in open condition. At the end of each stroke, the pressurized air is exhausted from the hammer bore to the atmosphere, causing particularly loud and irritating noise.

Heretofore such hammers have been provided with mufflers which embrace all or part of the hammer barrel. Such mufflers somtimes are torn open or removed. However, the workmen and service men quite often do not repair or replace the torn open or removed muffler with the result that the noise abatement is no longer effected. These mufflers are an addition to the original prior hammers and are an additional cost. The prior hammers are operable with or without the muffler.

SUMMARY

In accordance with the present invention, the hammer body includes a barrel and a muffler portion which embraces the barrel and which has tortuous internal passages into and through which the exhaust air discharged from the barrel must pass, these passages being arranged to reduce the velocity of the air discharged from the barrel and exhaust it to the atmosphere at low, and relatively constant, velocity and in muffled condition. The muffler portion is characterized by the fact that it includes ducts which are connected with control ports and their ducts in the barrel. They are necessary for the delivery of pressurized air to the bore and piston in a manner to cause piston operation. They function also as accumulators for pressurized air. They deliver pressurized air to the automatic valve in a manner to cause its sequential functioning. These ducts in the muffler are so arranged that upon removal of the muffler from the barrel, the control ports in the barrel are disconnected from the muffler ducts and are left open to the atmosphere in a manner which renders the hammer totally inoperable so long as the muffler remains removed.

The muffler portion may be composed of a resilient sound deadening material so as to muffle more effectively the sound of the exhaust air passing therethrough. It may be made in longitudinal sections, preferably two sections, which extend peripherally of the barrel and which can be installed readily on the hammer body by moving the sections radially of the barrel toward its axis and welding or cementing them in place in embracing relation to the barrel of the hammer. If the muffler is to be made detachable for any reason, the sections can be clamped in installed position by suitable detachable clamping means.

In this construction the muffler portion has through longitudinal passages, aligned with passages in the headers at the ends of the barrel, through which tie bolts are passed for clamping the muffler portion firmly in position endwise between the headers. One or more of these through passages is of greater diameter than its associated bolt so that the space between the bolt and passage walls can serve in some instances as passages for the admission of pressurized air to the barrel bore, or in other instances can serve as passages for exhaust air, as accumulators for pressurized air, or as means for conducting pressurized actuating air to the automatic valve.

Various specific objects and advantages will become apparent from the following description wherein reference is made to the drawing.

DESCRIPTION OF PREFERRED EMBODIMENT OF THE INVENTION

Figures 1, 12:
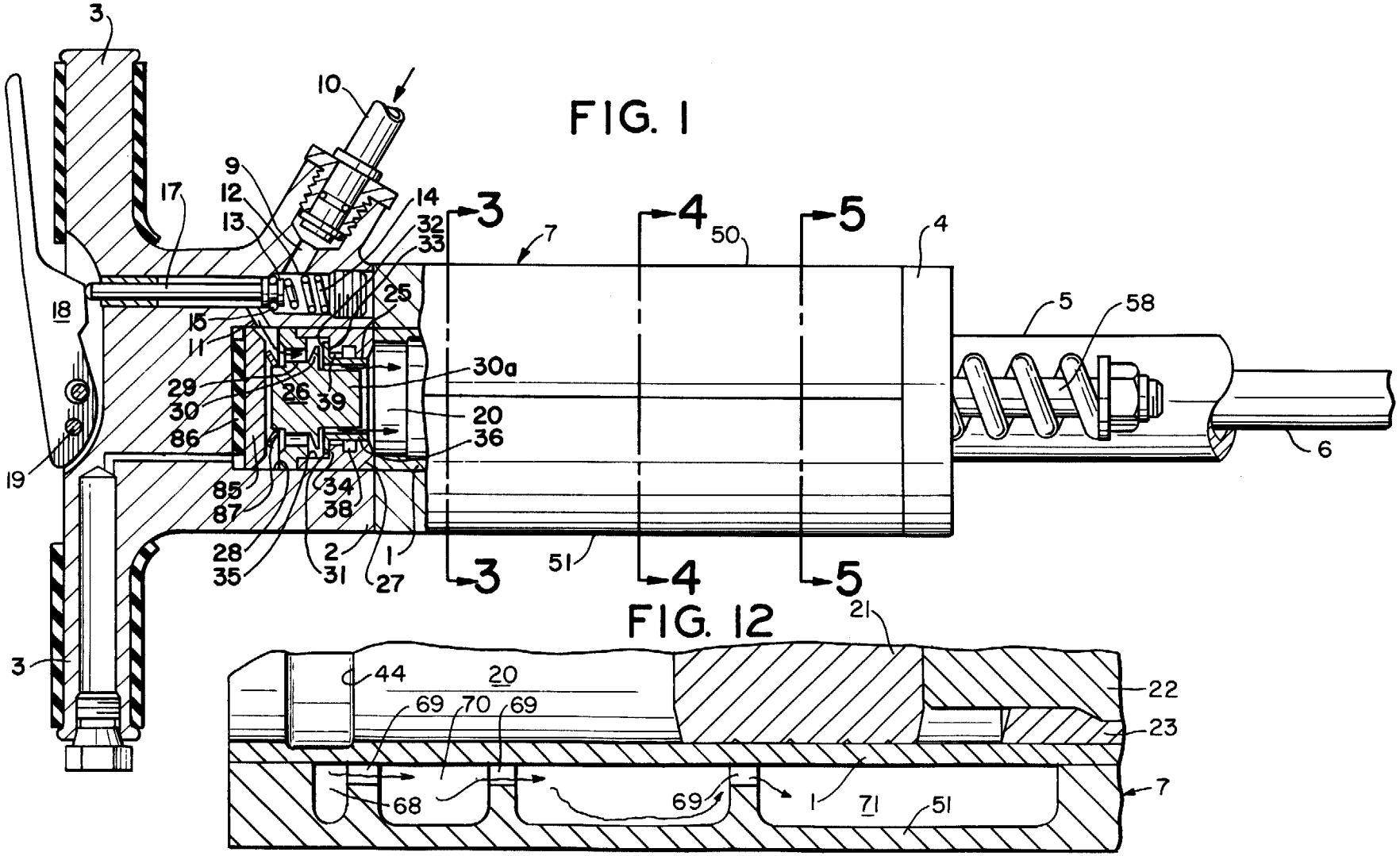
FIG. 1 is a longitudinal side elevation of a hammer embodying the principles of the present invention.
FIG. 12 is a fragmentary longitudinal sectional view of the hammer, and is taken on the line 12—12 in FIG. 3.

Referring to the drawing, the hammer comprises a body having a first portion including a barrel 1 having at its rear end a header 2 provided with opposite laterally extending handles 3 by which the hammer is supported and directed by an operator during use. At its opposite, or front end, the barrel has a header 4 with longitudinal guides 5 in which a tool 6 is guided for reciprocation axially of the barrel 1.

The body has a second or muffler portion 7 which encloses the barrel 1 throughout its length, and is hereinafter referred to as the muffler. The muffler 7 completely surrounds the barrel and extends from the header 2 to the header 4 and, at its ends, is in sealed relation to the headers, respectively.

The header 2 is provided with an inlet passage 9 which is connected by a suitable pressure hose 10 to a source of pressurized air. The inlet passage 9 supplies pressurized operating air to a suitable inlet duct 11 in the header 2 by way of a valve chamber 12 in which is a hand operated inlet valve 13, that is normally seated by a spring 14 on the seat 15. As best illustrated in FIG. 1 the valve 13 has an operating stem 17 that can be depressed by a lever 18, connected by a pivot 19 to the header 2, so that the operator can connect and disconnect the duct 11 selectively from the source of pressurized air.

As is conventional in such a hammer, the barrel is provided with a central axial bore 20 in which a piston 21 is reciprocable. The piston 21, on its power stroke, is arranged to deliver a blow on a tappet 22 which is slidably mounted in a suitable tappet seat element 23 secured in the barrel 1 and header 4 in the form illustrated in FIG. 2.

The header 2 carries automatic valve means for controlling the delivery of pressurized air from the inlet duct 11 to the bore 20 in a sequence to cause reciprocation of the piston 21. The automatic valve means shown for illustration may be one such as more fully described in my U.S. Pat. No. 4,105,080, issued Aug. 8, 1978. It includes an annular, axially reciprocable, valve 25 that cooperates with a valve cap 26 and a valve block 27, both mounted in the bore 28 in the header 2, for controlling the admission of air for driving the piston on its power and return strokes, alternately in succession.

As illustrated in FIG. 1, the inlet duct 11 leads into the rear of the bore 28 and passes therefrom through bores 29 in the cap 26 to a space between the cap 26 and block 27 in which the valve 25 is reciprocable. In order to provide for shifting of the valve 25 axially, by the air admitted through the bore 29, the cap 26 is provided with an external annular flange 30 and a reduced diameter forward projection **30*a*, and the valve 25 is provided with a cooperating flange 31 having an external rear end annular seat 32 that, in the retracted position of the valve 25, engages, and seals against, the forward face of the flange 30. At its opposite or front face the valve flange 31 has an annular seat 33 which engages and seats on a suitable seat 34 on the block 27. The flange 30 of the cap 26 is disposed in an enlarged diameter annular bore 35 in the block 27 as also is the flange 31 of the valve 25. The flanges 30 and 31 are of less diameter than the bore 35 so as to provide annular passages between the outer peripheries of the flanges and the inner peripheral wall of the bore 35**.

The valve 25 has a cylindrical annular body portion 36 which extends about the projection **30*a* on the cap 26** with radial clearance.

Thus, when air is admitted through the internal duct 11, it flows through the bore 29 into the annular bore 35 and around the outer periphery of the flange 30 so that it strikes the rear or abutment face of the flange 31, thus forcing the valve 25 forwardly into seating engagement with the seat 34, thus allowing air to flow past the seat 32 and pass between the flanges 30 and 31 into the clearance space between the body portion 36 and projection **30*a* of the cap 26, and thence into the bore 20 at the extreme left or rear of the bore 20**.

A valve operating duct 37 is provided in the header 2 and has a continuation **37*a* in the block 27 that opens into a channel 38 from which it can flow through a clearance space 39 between the valve body portion 36 and block 27 at the forward side of the flange 31. When the pressure of the air passing over the rear face of the flange 31 is reduced sufficiently, pressurized air passing through the space 39 can drive the valve 25 to the left or rear, causing the flange 31 to seat against the flange 30. Thereupon air from the annular channel 35 can pass around the outer edge of the flange 31 and past its seat 34 into the clearance space 39 and therefrom, in turn, through the channel 38 and the duct 37 for supplying return pressurized air for returning the piston 21 from its forward position at the front of the barrel 1 to its starting position at the rear of the barrel 1**.

The barrel 1 is provided with a radial exhaust port 40 disposed in spaced relation to the ends of the barrel, and a radial return air port 41 disposed forwardly from the exhaust port 40. The exhaust port 40 is positioned endwise of the barrel so as to be normally closed by the piston 41 in the retracted positions of the piston, but to be uncovered by the piston after the piston has reached an extended position in which it has delivered its power blow to the tappet 22, whereupon the exhaust port 40 vents pressurized air from the bore 20 at the left or rear of the piston. The return air port 41 is so positioned endwise of the barrel that it remains uncovered by the piston 21 until just before or just after the piston 21 has delivered its power stroke on the tappet 22.

Figure 2:
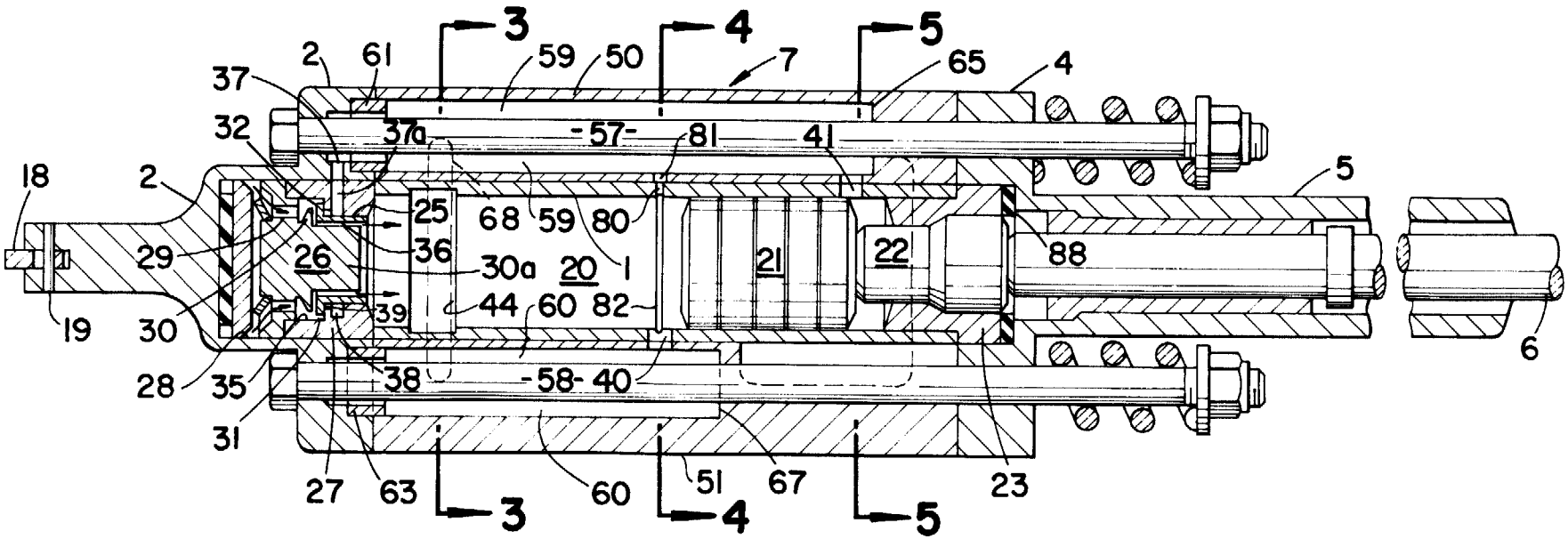
FIG. 2 is an enlarged vertical longitudinal sectional view of the hammer, and is taken on a vertical plane through the longitudinal axis of the hammer on line 2—2 in FIGS. 3, 4 and 5.
Figure 5:
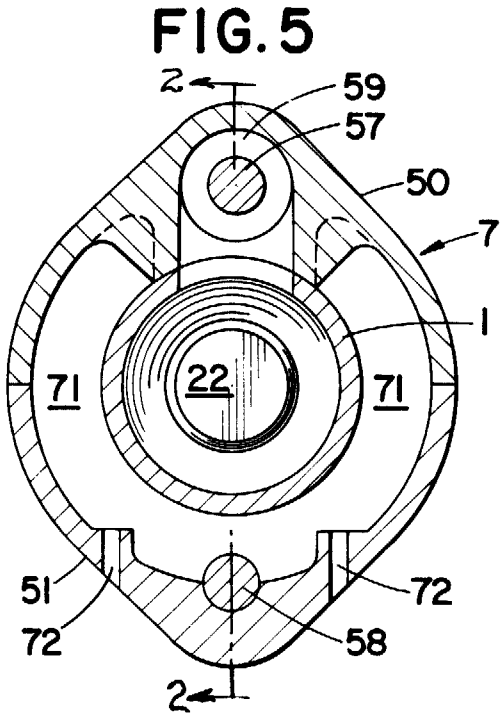
FIG. 5 is an enlarged cross sectional view of the hammer and is taken on the line 5—5 of FIGS. 1 and 2.
Figure 4:
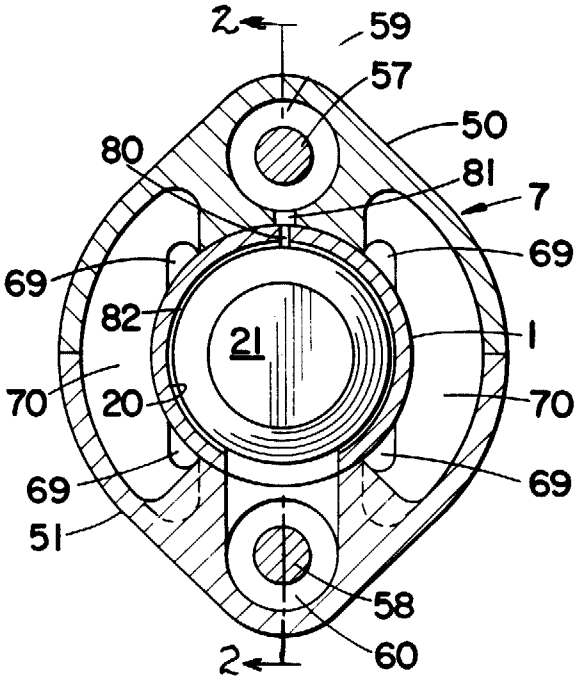
FIG. 4 is an enlarged cross sectional view of the hammer and is taken on the line 4—4 of FIGS. 1 and 2.
Figure 3:
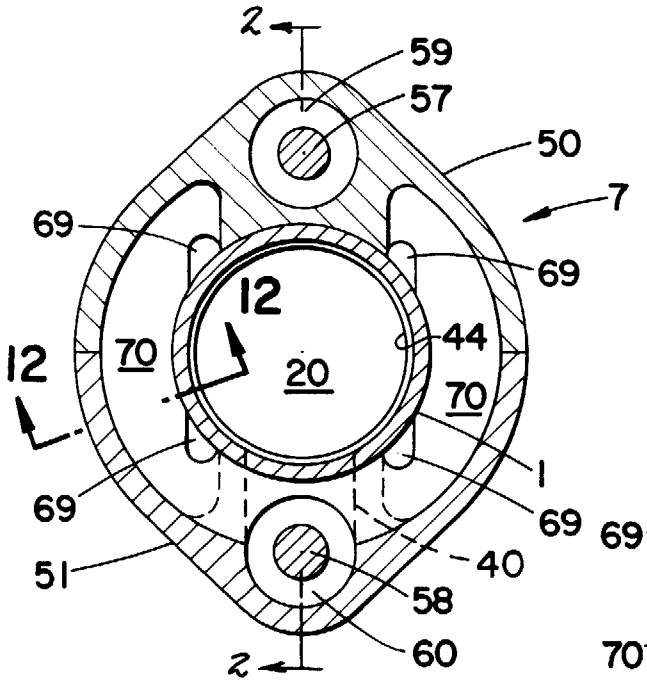
FIG. 3 is an enlarged cross sectional view of the hammer and is taken on the line 3—3 in FIGS. 1 and 2.
Figure 6:
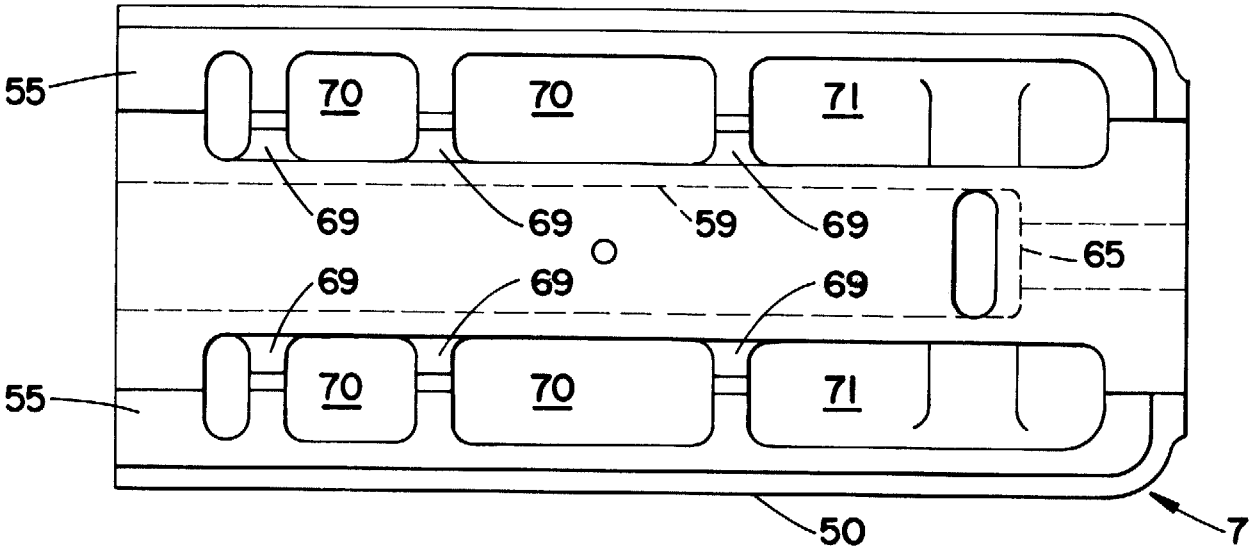
FIG. 6 is a bottom plan view of the section of the muffler portion of the hammber body through which air is admitted to the front of the piston, as illustrated in FIGS. 1 through 5.
Figure 8:
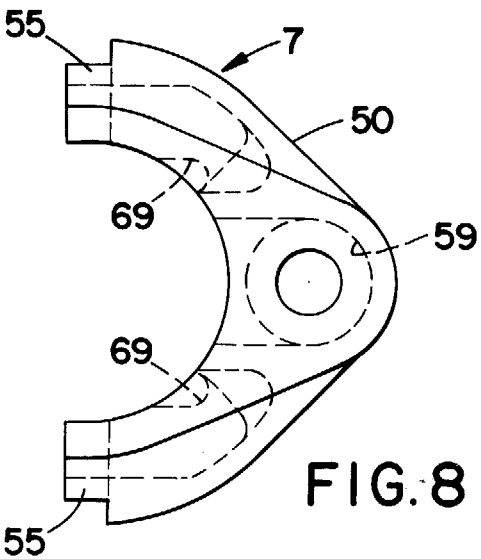
FIG. 8 is a right end elevation of the section of the muffler portion illustrated in FIG. 6.
Figure 7:
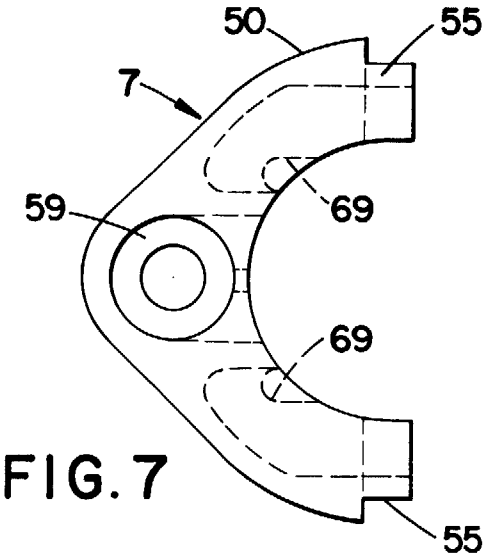
FIG. 7 is a left end elevation of the section of the muffler portion illustrated in FIG. 6.
Figure 9:
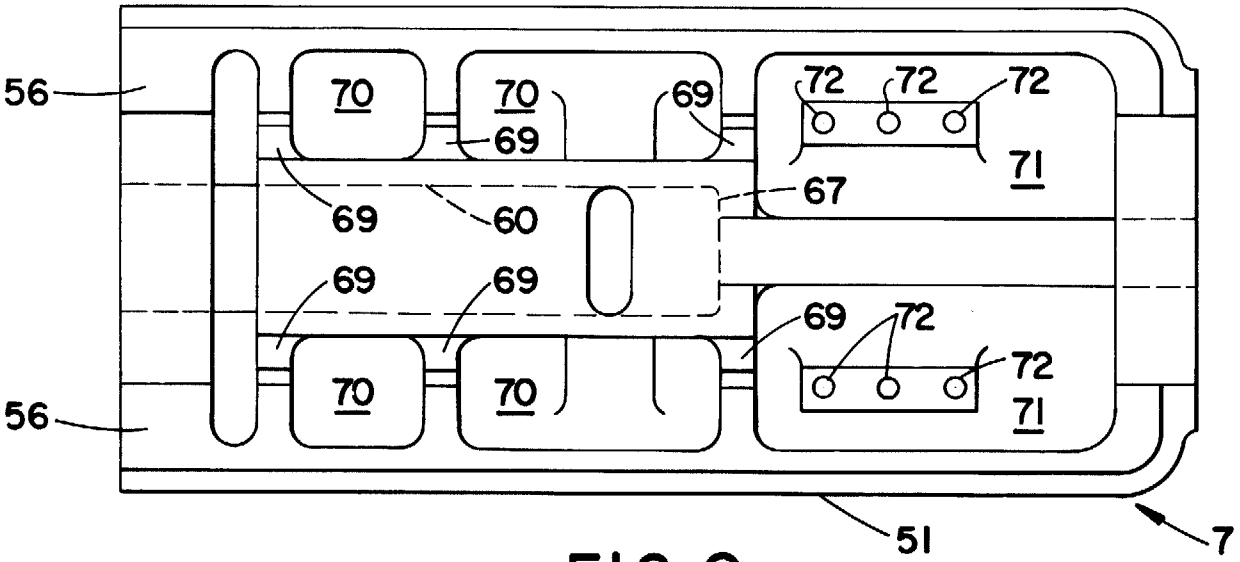
FIG. 9 is a top plan view of the lower or exhaust section of the muffler portion illustrated in FIGS. 1 through 5.
Figure 11:
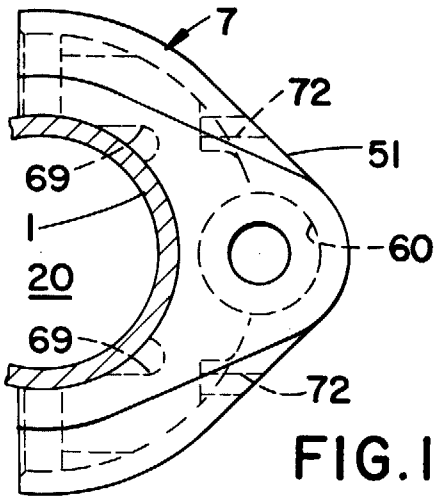
FIG. 11 is a right end elevation of the section of the muffler portion illustrated in FIG. 9, part of the hammer barrel being shown in section for clearness in illustration.
Figure 10:
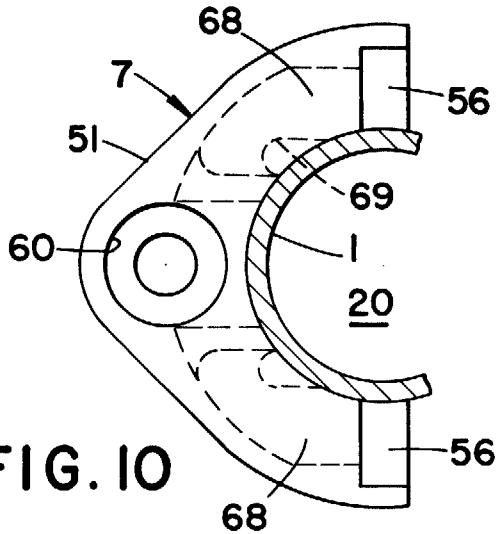
FIG. 10 is a left end elevation of the section of the muffler portion illustrated in FIG. 9, part of the hammer barrel being indicated in cross section for clearness in illustration.

Thus the air to the right, or in front, of the piston 21 in FIG. 2 is compressed by the piston to a certain degree during the power stroke of the piston. This compressed air is delivered to the exterior of the barrel by the port 41 and, as later explained, is accumulated and used for driving the valve 25 rearwardly so as to deliver pressurized air from the inlet 11 to the return duct 37 for driving the piston on its return stroke.

Within the barrel 1 is an enlarged circumferentially extending channel 44 that acts as an accumulator for the air which is compressed in the bore 20 to the rear of the piston 21 as the piston continues to move on its return stroke after it has covered and closed the exhaust port 40, thus providing cushioning air that is compressed by the piston to abosrb the inertial shock of the returning piston and that re-expands to assist in initiating the movement of the piston on its power stroke.

The hammer thus far described may be a conventional type of hammer, such as described in my U.S. Pat. No. 3,625,295, issued Dec. 7, 1971, except that, with the muffler removed, instead of ducts in the barrel 1 and header 2 being connected to the duct 37, the duct 37 opens to the atmosphere through the external wall of the header 2, and the ports 40 and 41 of the barrel are open through its external wall to the atmosphere.

As hereinbefore mentioned, the barrel is enclosed in the muffler 7, and the muffler may be made of metal, or if desired, of rather stiff, but resilient, material for more effective muffling of the noise of the exhaust air and reducing vibrations in the muffler itself. Also, the muffler is preferably made in sections separated from each other along radial parting planes through the axis of the muffler and extending longitudinally of the muffler from end to end.

In the form illustrated, the muffler 7 comprises a section 50 which delivers air to the front end of the hammer and an exhaust section 51, both of which are best illustrated in FIGS. 6 through 9. Each is substantially one radial half of a cylindrical shell.

As illustrated in FIG. 2, the opposite ends of the muffler sections are secured to the headers 2 and 4, respectively, by being abutted thereagainst and clamped therebetween by suitable tie bolts as hereinafter described.

For connecting the inlet and exhaust sections 50 and 51 together in sealed relation to each other, the inlet section 50 may be provided at its mating edges with suitable longitudinally extending tongues 55 and the exhaust portion may be provided at its mating edges with suitable complementary notches or grooves 56 into which the tongues 55 fit when the mating edges of the halves are juxtaposed to install the muffler in embracing relation to the barrel, with their open sides facing each other. Preferably, they are cemented together at these joints, or, they may be welded together, or clamped together, using a detachable clamp if they are to be readily removable.

As mentioned above, the muffler as a whole is held clamped firmly between the headers 2 and 4 by means of suitable tie bolts 57 and 58. The bolts extend longitudinally of the muffler through suitable passages 59 and 60, in the muffler sections 50 and 51, respectively. Suitable sealing rings 61 and 63 may be provided at the ends of the passages 59 and 60 adjacent the header 2 for forming an effective seal between the header and muffler and for assuring proper alignment and passage for exhaust of air from the exhaust port 40, and for return air to the duct 37.

As best seen in FIG. 2, the passage 59 extends endwise of the section 50 from the header 2 to an internal radial wall 65 in the section 50. At a position to the left of the return duct 37, the passage 59 is of larger diameter than the bolt 57 so that the annular space therebetween provides a passage from the return duct 37 to port 41. Thus air compressed in front of the piston as it moves on its power stroke beyond the exhaust port 40, is compressed and accumulated in the passage 59, and delivered through the port 41 and passage 59, to the duct 37 and thence to clearance space 39, so as to act on the front face of the flange 31 and unseat and move the valve 25 to the position for admitting pressurized air from the inlet 11 through bores 29, around the flanges 30 and 31, space 39, channel 38, continuation duct 37*a* in block 27, duct 37, and passage 59, and port 41 to the right end of the bore 20. This accumulated and pressurized air drives the piston 21 on its return stroke. Thus neither the air compressed by the piston in front of the bore 20 and used to shift the automatic valve 25 nor the return air from the pressurized source for returning the piston can be supplied except through the muffler. Accordingly, while the muffler is removed, the hammer is rendered inoperative.

The passage 60 also is restricted near its right end by an annular wall 67, and, at the left of the wall 67, is of larger diameter than the volt 58. The annular space between the bolt 58 and wall of the passage 60 is connected to the exhaust port 40 so that exhaust air discharged from the port 40 enters the annular space in the passage 60 and flows to the left or rearwardly of the hammer into the enlarged annular passages 68 in the exhaust section 51. The air can escape from the annular passage 68 only by passing through restricted passages 69 and enlarged passages 70, arranged alternately in succession endwise of the muffler 7, as best illustrated in FIG. 12. The last restricted passage 69 at the forward end of the muffler connects with an enlarged passage 71 at the right end of the muffler. The passage 71 is connected to the atmosphere by suitable restricted ports 72. The passages 69 and 70 are in the form of concavities of different radii, respectively, formed partly in the respective halves 50 and 51 of the muffler 7, and with their open sides closed by the barrel 1 so that they, in effect, form peripherally closed interconnected passages arranged in series from the passage 68 to the exhaust ports 72.

Thus it will be seen that while the muffler 7 is removed from the barrel 1, the port 41 is disconnected from the duct 37 so that the air compressed to the right of the piston 21 cannot enter the duct 37 and shift the automatic valve 25, and after the valve is shifted, pressurized air from the inlet 11 cannot be delivered through the duct 37 to the port 41 for driving the piston 21 on its return stroke.

It sometimes happens in such hammers, especially when they have remained idle for long intervals, that the piston and automatic valve drift forward to a position in which the piston closes the exhaust port. In such cases dead air is trapped in the bore 20 at the front end of the piston and tends to prevent the from advancing instantly sufficiently to uncover the exhaust port 40 when the air is turned on. A bleed duct, indicated at 80, is provided and is connected to bore 20 at a point about opposite the exhaust port 40 and connects with an aligned radial bore 81 in the muffler 7. The bore 81 leads to the passage 59 which is connected with the port 41 at the front of the bore 20. A small circumferential by-pass channel 82 in the barrel 1 connects the bleed duct 80 with the exhaust port 40. Thus the piston operation starts instantly upon admission of live air by the manual inlet valve. As a result, air that otherwise would be trapped in front of the piston, is vented through the passage 59, bore 81, bleed duct 80 and channel 82 to the exhaust port 41.

Due to the resiliency of the muffler, vibrations created by the inlet air and exhaust air are generally isolated from the headers 2 and 4 and handles 3.

If desired, the percussively generated vibrations created by the inlet live air and the compression of air by the piston itself at the ends of the bore 20 may be damped. For this purpose, an abutment element 85 may be fitted into that end of the bore 20 adjacent the valve cap 26 and valve block 27. The element 85 preferably is movable axially of the bore 20. The element 85 has a reduced diameter shank portion 86 which bears against the adjacent end wall of the bore 20. That end of the block 26 adjacent to the element 85 carries a washer 87 which bears against the forward face of the element 85 so as to transmit thereto percussive shocks imposed on the cap 26 and block 27. The shank portion 86 or, in fact, both the element 85 and its shank portion, may be of resilient cushioning material for dampening the percussive shocks on the cap 26 and block 27 and isolating them from the header 2 and handles 3.

Similarly, at the opposite end of the bore 20, a resilient cushioning washer 88 may be interposed between the tappet seat element 23 and the annular end wall of the bore 20 adjacent to the element 23, for damping percussive vibrations resulting from compression of air in front of the piston 21, especially after it has passed the port 41 on the power stroke of the piston, thus isolating such vibrations from the header 4.

It is to be noted that the exhaust port 40 is positioned so that it is opened to exhaust only after the piston 21 has neared the completion of its power stroke and is closing the port 41, thereby entrapping and compressing a quantity of air in front of the piston to cushion its impact on the tappet seat element 23, and thereby on the tool end of the hammer, and start it on its return stroke. The port 41 not only causes this air, before the port 41 is fully closed, to shift the valve 25 to its position for admitting live air to the front of the piston for driving the piston fully on its return stroke, but also, on the power stroke after rebound of the piston, connects the passage 59 to the bore 20 so that the passage 59 is operable as an accumulating chamber of air being compressed in front of the piston 21 as the piston moves on its power stroke before it closes the port 41, thus establishing a supply of compressed air for assisting in return of the piston after its rebound at completion of its power stroke when the port 41 is again opened. By the combination of the muffler and such porting, the hammer structure is simplified and adapted for economical production.

Having thus described my invention, I claim:

1. An air hammer including a body having a bore, an inlet passage, and an exhaust passage;

a piston reciprocable in the bore by pressurized air;

a muffler on the body for muffling the exhaust of the air; and means rendered operative by removal of the muffler from the body, to render the piston inoperable by the pressurized air.

2. An air hammer comprising a hammer body having a power portion and a muffler portion, said power portion including a barrel with a bore having a front end and a rear end;

one of said portions having an air inlet for pressurized air;

a piston reciprocable in the bore and driven, alternately toward said front end on a power stroke and toward said rear end on a return stroke, by pressurized air from said inlet;

an automatic valve in one body portion for controlling the flow, to opposite ends of the bore, alternately in succession, of that pressurized air which is admitted through the inlet, and for controlling the flow of air pressurized by the piston;

said body, including the muffler portion, having air passage means which are operative to act as accumulators for accumulating pressurized air and to admit pressurized air into the bore and to the automatic valve in a manner to operate the valve and cause said reciprocation of the piston, while the body portions are connected together in assembled relation, and which air passage means are disrupted, and thereby disrupt the flow of said pressurized air to the bore and to the automatic valve in said manner and thereby disrupt the operation of the hammer, by disconnection of the muffler portion from the power portion.

3. The structure according to claim 2 wherein said muffler portion comprises circumferentially separable sections having mating edges extending endwise of the barrel; and said sections are assembleable on the barrel by moving them, radially of the barrel, into embracing relation to the barrel, and then connecting them in said relation.

4. The structure according to claim 2 wherein:

said bore extends forwardly and rearwardly of the barrel;

the piston is reciprocable in the bore forwardly to extended positions and rearwardly to retracted positions, respectively;

said passage means are connected to said inlet and to the bore near the rear of the power portion;

a first control air port is provided at the rear of the power portion and is connected to the bore by way of a portion of said passage means, and at its outer end is open to the exterior of said power portion;

a second control air port is provided in said power portion and is connected at its inner end to the bore near the forward end of the bore and at its outer end is open to the exterior of the power portion;

an exhaust port is provided in the power portion and is connected at its inner end to the bore between said first and second ports and is open at its outer end to the exterior of the power portion, and is located so that its inner end is closed by the piston in retracted positions of the piston and is uncovered by the piston, and thereby opened, in certain extended positions of the piston;

the automatic valve means are operative in a first position to admit pressurized air from the inlet to the rear of the bore at the rear of the piston while disconnecting said first port from the inlet, and operative in a second position to disconnect the inlet from the rear of the bore and to connect it to said first port; and said valve means being movable repeatedly alternately, by presurized air from the inlet to said first and second positions, successively;

said muffler portion, when the body portions are secured together, providing muffling passage means connected to the outlet of the exhaust port;

said muffling portion has outlet means connecting the muffling passage means to the atmosphere; and said muffler portion, when so secured, has duct means for pressurized air connecting the outer ends of said first and second control ports together, whereby removal of the muffler renders the hammer inoperative.

5. The structure according to claim 4 wherein said muffling passage means are in the muffler portion of the body.

6. The structure according to claim 5 wherein the said muffling passage means comprise enlarged passages spaced from each other and interconnected in series by restricted passages.

7. The structure according to claim 6 wherein said enlarged passages are enlarged open sided cavities which are open radially inwardly toward the barrel and of which the open sides are closed radially by the exterior wall of the barrel.

8. The structure according to claim 7 wherein said restricted passages are open sided restricted cavities smaller than said enlarged cavities and are open radially inwardly toward the barrel and of which the open sides are closed by the exterior wall of the barrel.

9. The structure according to claim 6 wherein said enlarged cavities and restricted cavities are arranged alternately in series endwise of the barrel so that the exhaust air passes alternately through enlarged and restricted passages repeatedly in passing through said exhaust passage means.

10. The structure according to claim 2 wherein the muffler portion of the body has at least one longitudinal passage which extends entirely through the muffler portion and is open at both ends;

end headers are carried on opposite ends of the power body portion and engage the opposite ends of the muffler portion, respectively, and have end passages aligned, respectively, with said through passage in the muffler portion;

a tie bolt extends through said through passages;

said tie bolt is of smaller diameter than said through passage so that a clearance space for said air flow is provided between the exterior wall of said bolt and the interior wall of the through passage; and at least part of said clearance space is a part of said air passage means.

11. An air hammer comprising:

a body having headers at its opposite ends, respectively, and having a bore extending endwise of the body;

a piston reciprocable in the bore;

air passage means in the body and connected to the inlet;

an automatic valve in, and forming part of, the passage means, and operative to admit pressurizing air into the bore in a manner to cause reciprocation of the piston by the pressurized air;

said body having a plurality of offset passages extending in a direction endwise of the body and offset from said bore;

tie bolts connecting the headers and biasing them firmly against the ends of the body;

at least some of said offset passages each having a portion which is larger in cross section than their associated tie bolt;

said tie bolts being disposed in, and extending endwise through, said portions of the associated passages; and the clearance space between each of said bolts and the peripheral wall of said portion of its associated passage being part of said air passage means.

12. The structure according to claim 11 wherein said offset passages extend entirely through the body from one header to the other; said headers have passages, respectively, which are aligned with each other and with the passages in the body; the tie bolt extends through aligned ones of said passages, respectively; and means are provided for sealing the clearance space between said bolts and the walls of the associated offset passage in the power portion of the body at the ends of the offset passages in the body.

13. The structure according to claim 11 wherein the outer portion of the body is in the form of a muffler, and said offset passages are in said muffler.

14. The structure according to claim 2 wherein the muffler portion is molded and the passage means are molded therein.

15. The structure according to claim 14 wherein said muffler portion has longitudinal passages molded therein and forming part of said passage means.

16. The structure according to claim 1 wherein cushioning means are mounted in at least one end of the bore and are operative to dampen percussive shocks at said end of the bore.

17. The structure according to claim 4 wherein the muffler portion is molded and has certain ports molded therein which are aligned with, and connect with, certain complementary ports in the power portion when the portions are assembled.

18. The structure according to claim 4 wherein the muffler portion is molded and the muffling passage means are molded therein.

19. The structure according to claim 14 wherein at least part of the passage means act as accumulators and are molded therein.

* * * * *